US005913984A

United States Patent [19]

Löfdal

[11] Patent Number: 5,913,984

[45] **Date of Patent: *Jun. 22, 1999**

[54] ARRANGEMENT DESIGNED TO BE A PART OF AN EQUIPMENT FOR CLEANING DIFFERENT OBJECTS IN A FOOD PROCESSING PLANT

[75] Inventor: Jan Löfdal, Lund, Sweden

[73] Assignee: Alfa Laval AB, Lund, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/885,928

[22] Filed: Jun. 30, 1997

Related U.S. Application Data

[63] Continuation of application No. 08/387,887, filed as application No. PCT/SE93/00707, Aug. 27, 1993.

[30] Foreign Application Priority Data

Aug. 31, 1992 [SE] Sweden ..... 9202496

[51] Int. Cl.[6] ..... B08B 9/08; B08B 13/00

[52] U.S. Cl. ..... 134/18; 134/22.18; 134/29; 134/56 R; 134/95.1; 134/169 R; 137/486; 417/43

[58] Field of Search ..... 134/56 R, 57 R, 134/95.1, 169 R, 169 A, 169 C, 18, 22.18, 29; 417/43; 137/486, 487.5

[56] References Cited

U.S. PATENT DOCUMENTS

| | | | |
|---|---|---|---|
| 2,665,772 | 1/1954 | Greer et al. | 134/169 A X |
| 3,081,947 | 3/1963 | Walter | 134/57 R |
| 3,370,607 | 2/1968 | Minges | 137/486 |
| 3,568,771 | 3/1971 | Vincent et al. | 417/43 X |
| 3,841,351 | 10/1974 | Shida | 134/57 R |
| 5,351,705 | 10/1994 | Reinders et al. | 137/487.5 X |

FOREIGN PATENT DOCUMENTS

| | | |
|---|---|---|
| 0027007 | 4/1981 | European Pat. Off. . |
| 2163307 | 7/1972 | Germany . |
| 3642611 | 6/1988 | Germany . |
| 2140121 | 11/1984 | United Kingdom . |
| 2240708 | 8/1991 | United Kingdom . |

*Primary Examiner*—Philip R. Coe
*Attorney, Agent, or Firm*—Fish & Richardson P.C.

[57] ABSTRACT

The invention relates to equipment for cleaning objects such as tanks, pipeline systems etc. in a food treatment plant. The equipment includes a liquid conveying system which is arranged to convey a variable controlled amount of liquid at a variable controlled flow rate. In series with this means system there is a volume and/or flow rate metering device and a control device connected to the volume and/or flow rate metering device and receiving a signal from the metering device. The control device is arranged to actuate the conveying system in response to this signal so that the desired amount of liquid is conveyed at a desired flow rate. The conveying system and the volume and/or flow rate metering device are arranged in a flow path supplying rinsing or cleaning liquid to one or several objects to be cleaned.

19 Claims, 1 Drawing Sheet

ARRANGEMENT DESIGNED TO BE A PART OF AN EQUIPMENT FOR CLEANING DIFFERENT OBJECTS IN A FOOD PROCESSING PLANT

This is a continuation of U.S. application Ser. No. 08/387,887, filed Apr. 4, 1995, now abandoned, which was a U.S. national phase application based on PCT/SE93/00707, having an international filing date of Aug. 27, 1993, and claims the priority of Swedish patent application 9202496-7, filed Aug. 31, 1992.

The present invention relates to an arrangement designed to be a part of equipment for cleaning different objects such as tanks, pipe line systems etc. in a plant for processing foods.

Mechanical and often automatic methods are used today for cleaning equipment in food processing plants. The cleaning takes place in a circulation path without any need for dismantling the equipment. CIP (Cleaning-in-place) may be defined as circulation of the rinsing and cleaning solutions through equipment and plant parts which are connected to a circulation path. When a cleaning solution passes the surfaces which are to be cleaned, chemical and mechanical working of the residues on the surfaces takes place which is a necessity for a good cleaning effect. Different objects with differing contaminations demand varying cleaning programs in order to obtain a satisfactory cleaning result. A cleaning program mentioned as an example may comprise prerinsing for 5 minutes, circulation of alkaline detergent (lye) for 20 minutes, rinsing with warm water, circulation of acid solution for 15 minutes, rinsing with disinfectant for some minutes and post rinsing with water during 5 minutes.

In the systems which are used today, the cleaning program is controlled by time control, i.e. the pump which transports the rinsing or cleaning solution to or from the object works with a theoretical capacity during a certain time.

As the flows are large, this means that even if the pumps theoretically have the same known capacity, deviations may occur which, for example, means that the tanks, when one changes from rinsing to cleaning with lye are not empty, as they should be. If an amount of water is left in the tank, the cleaning solution will be diluted, which may cause an incomplete cleaning in the preceding step. The use of unnecessarily large amounts of water and cleaning solutions also implies unneeded expenses. Since the same cleaning controls are used for tanks with different volumes, it is difficult to adjust the cleaning programs to each separate tank arrangement.

According to the invention an arrangement designed to be used in equipment for cleaning of food processing plants is therefore proposed which arrangement avoids the problems mentioned above. The arrangement according to the invention comprises means for conveying a variable, controlled amount of liquid with a variable controlled flow rate, means for metering the volume or the flow rate connected in series with the conveying means and a control means connected to the volume and/or flow rate metering means and receiving signals from the same, which control means is arranged to actuate the means for conveying the liquid in dependence of this signal in such a way that a desired amount of liquid is conveyed with a desired flow rate, at which the conveying means and volume and/or flow rate metering means are arranged in a conduit for conveying rinsing- or cleaning liquid to one or several objects which are to be cleaned.

According to the invention the means for conveying the liquid consists of a regulate pump, at which the control means is arranged to regulate the capacity of the pump. If it is suitable, a pump with well defined volumetric qualities may be used instead, which pump is adjustable between different capacities.

Another suitable combination consists of a pump and a regulating valve connected to the same, at which the control means is arranged to affect the through flow area of the regulating valve. This arrangement is, however, more expensive in purchase than the arrangement described above.

A preferable solution from economical point of view is to use a frequency controlled centrifugal pump for conveying the different solutions which are used in the cleaning program.

Referring to the drawing.

An arrangement according to the invention may, as has been mentioned, be used for several objects or pipe lines which are to be cleaned and which demand different cleaning flows and volumes. Each object has its own desired value of flow rate and amount for the respective step in the cleaning cycle. The desired value is used as a reference to control the system to give the right flow by forwarding a suitable signal to the pump or the regulating device.

Figure 1:
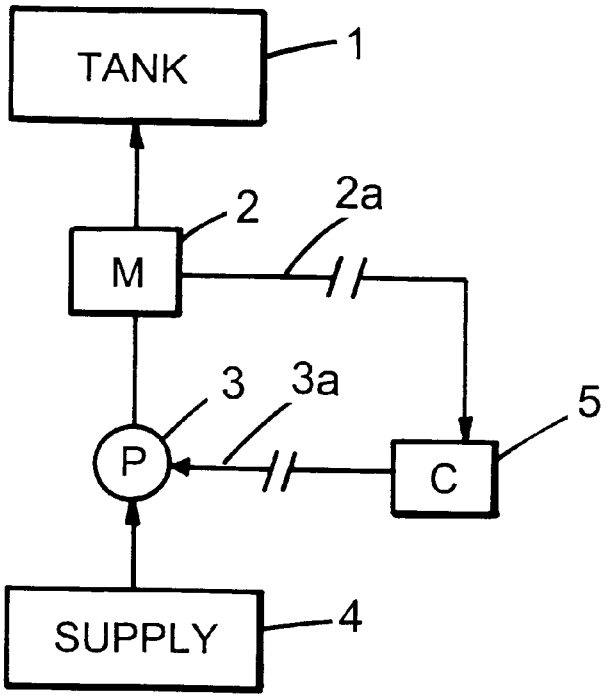
FIG. 1 is a schematic flow diagram of a system according to the invention in which the flow of cleaning fluid is regulated by regulating the capacity of a pump.
Figure 2:
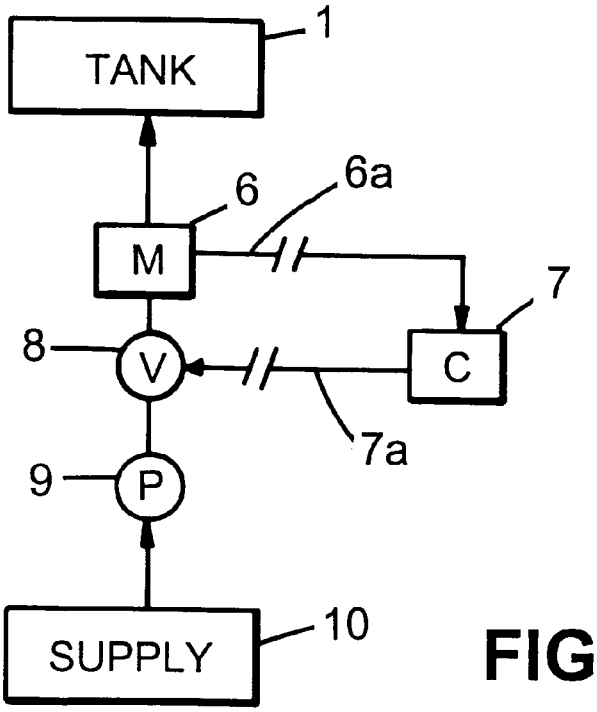
FIG. 2 is a schematic flow diagram of a system according to the invention in which the flow of cleaning fluid is regulated by adjusting a regulating valve.

Referring to FIG. 1, a system according to the invention in which a tank 1 to be cleaned is connected to a frequency controlled centrifugal pump 3, via a metering device 2. The pump is in turn connected to a supply of cleaning fluid 4. Metering device 2 communicates via a line 2*a* to a controller 5 which in turn regulates via line 3*a*, the pump 3. In the alternative arrangement shown in FIG. 2 a regulatory valve 8 is connected between a pump 9 and the flow meter 6. The rate of flow of cleaning fluid is measured by meter 6 and the information conveyed to control device 7 via line 6*a*. The flow rate is then regulated by device 7 adjusting the setting of valve 8 via line 7*a*.

In FIG. 1, the flow meter 2 arranged in series with the pump 3 senses the flow which passes the flow meter and gives a corresponding signal to control means 5. If the desired flow rate deviates from the desired value, the control means 5 adjusts the number of revolutions of the pump 3 in such a way that the desired value is obtained.

This ability to obtain a carefully defined flow, the value of which is adjusted to each object which shall be cleaned and also to the desired function during a certain cleaning program, makes possible considerable savings both as regards the used amount of water, the consumption of energy when heating the cleaning solutions and also the used amounts of lye, acid and desinfectants.

The information from the flow/volume meter 2 is used to control the borderline between different solutions used during the steps in the cleaning cycle. With knowledge about these borderlines the pump 3 may be stopped during a certain period in order to hinder mixing of different solutions for example in the tank.

Below there is described how the arrangement may be used during some of these steps which are part of a cleaning cycle.

In practice a cleaning device may be situated in the upper part of a tank to be cleaned. A certain flow through the cleaning device is needed for cleaning. The cleaning device sprays rinsing or cleaning solution into the tank. This flow is calculated for each combination of cleaning device and tank and in order to obtain a satisfactory cleaning of the tank this value must be obtained. Due to the careful control of the flow which may be obtained with the arrangement according to the invention, exactly the desired amount may be supplied to the tank. With techniques generally used today the flows through the plant fluctuate such that the result of the cleaning varies. This is compensated by using a longer cleaning time which gives higher costs for the cleaning operation.

It is not only the ability to optimize the amount of solution during a certain step in the program which is valuable. During cleaning of tanks a return pump arranged in the bottom of the tank is used to pump out the amount of rinsing or cleaning solution from the tank. This pump is usually self priming and works with a certain capacity. When a step in the cleaning program has been ended, there is, if the right relation prevails between the capacity of the cleaning pump and the capacity of the return pump, only a limited volume of liquid left in the tank. The next step in the cleaning program adds new medium, for example lye solution. If the tank is mainly empty, i.e. only contains the known limited volume of liquid, a minimal dilution of the lye solution takes place. If a larger amount of liquid from the preceding step is left in the tank, the lye solution firstly pumped out from the tank will be so diluted that it must be conveyed to waste or concentration.

In a well functioning cleaning system the used cleaning solutions, i.e. the lye and acid solutions, are returned to the supply tanks when the cleaning program has been carried through and the same solutions may be used during some or several weeks.

The arrangement according to the invention may also with advantage be used in the case where rinsing with a disinfectant is part of the final step in the cleaning program. The disinfectant is then pumped directly into the system by means of a concentrate pump. The capacity of the pump which is part of the arrangement or where appropriate the regulating device is adapted to the capacity of the concentrate pump in such a way that the right concentration of the disinfecting solution is obtained.

With an arrangement according to the invention there is also obtained a control of the amount of energy that has been used in the cases where the rinsing or cleaning solutions are heated by passing a heat exchanger connected before the inlet to the object which shall be cleaned. Due to the fact that the flow of incoming rinsing or cleaning solution is known, the amount of heat which shall be added from a medium giving off heat may be exactly calculated.

The arrangement according to the invention may be used for preparation of e.g. lye or acid solutions in the same way as has been described for the preparation of disinfectant solutions. In this way earlier used burdensome preparations which have involved addition of water, addition of concentrate, mixing, measuring of the concentration, a possible new addition of concentrate, new mixing and so on may be avoided entirely.

I claim:

1. Cleaning system for cleaning food treating equipment comprising conveying means for transporting a variable, controlled amount of liquid at a variable controlled flow rate to said equipment, metering means connected in series with said conveying means for measuring the volume and flow rate of liquid transported by said conveying means and generating signals representative thereof, and control means connected to said metering means for receiving signals from said metering means, said control means being connected to said conveying means to insure that a desired amount of liquid is conveyed to said equipment at a desired flow rate, said conveying means and metering means being arranged in a conduit for conveying rinsing or cleaning liquid to said equipment.

2. Arrangement according to claim 1, wherein the means for conveying the liquid, comprises a regulate pump, said control means being arranged to regulate the capacity of the pump.

3. Arrangement according to claim 2, wherein the pump is a frequency controlled centrifugal pump.

4. Arrangement according to claim 1, wherein the means for conveying liquid comprises a pump and a regulating valve connected to said pump, said control means being arranged to affect the flowthrough area of the regulating valve.

5. In a process for cleaning each of a plurality of food-treating equipment items with alkaline detergent solution, acid solution and a plurality of aqueous rinse solutions, the improvement comprising, determining for each equipment item a cleaning program comprising a choice and order of solutions and a rate and duration of flow of each solution in the program, delivering the selected solutions in the selected order to each equipment item through a first pump whose throughput is controllably adjustable, removing the solutions from each equipment item, wherein each equipment item is substantially emptied before delivery of each of said alkaline detergent and acid solutions, measuring the volume or flow rate of each solution being delivered, generating signals representative thereof, and in response to said signals adjusting the flow rate to said determined flow rate.

6. The process according to claim 5 wherein at least one rinse solution is a disinfectant solution.

7. The process according to claim 6 comprising the additional steps of heating at least one solution during its delivery to at least one equipment item and setting the rate of heating according to the determined flow rate.

8. The process according to claim 5 comprising the additional steps of heating at least one solution during its delivery to at least one equipment item and setting the rate of heating according to the determined flow rate.

9. The process according to claim 5 comprising the additional steps of preparing at least one of said solutions by pumping, by means of an adjustable flow-rate concentrate pump, a concentrate into a water stream flowing through said first pump and adjusting the flow rate of the concentrate pump according to adjustments in the speed of said first pump in order to maintain the desired concentration of said at least one solution.

10. The process according to claim 5 wherein said step of removing includes stopping said first pump following completion of delivery of each of said solutions as necessary to permit the equipment item to empty to a desired extent before pumping the next solution to said equipment item.

11. The process according to claim 5 wherein said step of removing includes using a second pump to empty the equipment item.

12. The process according to claim 5 wherein said throughput is controlled by a flow-regulating valve and wherein the step of adjusting the flow rate includes signalling the regulating valve.

13. The process according to claim 5 wherein said first pump is a variable-speed pump and wherein the step of adjusting the flow rate includes adjusting the speed of said pump.

14. An arrangement for an apparatus for treatment of food for use in cleaning at least one part of the apparatus, the arrangement comprising a conduit for conducting a liquid supplied from a liquid source to the apparatus during a cleaning operation, and adjustable flow controlling means connected in the conduit to control the rate of liquid flow through the conduit, wherein metering means are connected in the conduit in series with the flow controlling means to sense and to signal the volume of liquid flow and the rate of liquid flow through the flow controlling means, and a control means coupled to the metering means and to the flow controlling means responsive to signals received from the metering means to adjust the flow controlling means to establish a desired rate of flow of liquid through the conduit to the apparatus being cleaned, whereby a desired amount of liquid is supplied to the apparatus.

15. The arrangement according to claim 14, wherein the control means is arranged to adjust the flow controlling means to establish a plurality of different desired flow rates during cleaning of different parts of the apparatus.

16. The arrangement according to claim 14, wherein the control means permits different amounts of liquid to pass through the conduit during cleaning of different parts of the apparatus.

17. The arrangement according to claim 14, wherein the flow controlling means comprises a regulatable pump, the control means being arranged to regulate the capacity of the pump.

18. The arrangement according to claim 17, wherein the pump is a frequency controlled centrifugal pump.

19. The arrangement according to claim 14, wherein the flow controlling means comprises a pump and a regulating valve connected thereto, the control means being arranged to influence the through flow area of the regulating valve.

* * * * *

UNITED STATES PATENT AND TRADEMARK OFFICE

CERTIFICATE OF CORRECTION

PATENT NO. : 5,913,984

DATED : Jun. 22, 1999

INVENTOR(S) : Löfdal

It is certified that error appears in the above-identified patent and that said Letters Patent is hereby corrected as shown below:

Col. 1, line 67, change "regulate" to --regulable--.

Col. 4, line 5, change "regulate" to --regulable--.

55284.N11

Signed and Sealed this

Thirtieth Day of November, 1999

*Attest:*

*Attesting Officer*

Q. TODD DICKINSON

*Acting Commissioner of Patents and Trademarks*